US010670356B2

(12) United States Patent
Bandurko

(10) Patent No.: US 10,670,356 B2
(45) Date of Patent: Jun. 2, 2020

(54) RETROFIT ADJUSTABLE GAS VALVE FOR LONG-STROKE PISTON-OPERATED FIREARM

(71) Applicant: Vasym Tadzhi, Kiev (UA)

(72) Inventor: Volodymyr Bandurko, Kiev (UA)

(73) Assignee: Vasym Tadzhi, Kiev (UA)

( * ) Notice: Subject to any disclaimer, the term of this patent is extended or adjusted under 35 U.S.C. 154(b) by 0 days.

(21) Appl. No.: 16/390,388

(22) Filed: Apr. 22, 2019

(65) Prior Publication Data

US 2020/0025478 A1 Jan. 23, 2020

Related U.S. Application Data

(60) Provisional application No. 62/663,320, filed on Apr. 27, 2018.

(51) Int. Cl.
*F41A 5/28* (2006.01)

(52) U.S. Cl.
CPC ..... *F41A 5/28* (2013.01)

(58) Field of Classification Search
CPC ..... F41A 5/28; F41A 5/18; F41A 5/24
USPC ..... 89/193
See application file for complete search history.

(56) References Cited

U.S. PATENT DOCUMENTS

| | | | | |
|---|---|---|---|---|
| 2,791,944 | A * | 5/1957 | Harvey | F41A 5/28 89/193 |
| 2,845,008 | A * | 7/1958 | Atwood, Jr. | F41A 5/28 89/193 |
| 3,020,807 | A * | 2/1962 | Hailston | F41A 5/28 89/193 |
| 7,637,199 | B2 * | 12/2009 | Fluhr | F41G 1/02 89/191.01 |
| 9,032,860 | B2 | 5/2015 | Faxon | |
| 9,377,257 | B2 | 6/2016 | Foster | |
| 9,816,769 | B1 | 11/2017 | Brown | |
| 2011/0179945 | A1 * | 7/2011 | Clark | F41A 5/18 89/193 |
| 2014/0076149 | A1 * | 3/2014 | Adams | F41A 5/28 89/192 |
| 2015/0176933 | A1 * | 6/2015 | Adams | F41A 5/28 89/191.02 |
| 2018/0156553 | A1 * | 6/2018 | Rode | F41A 5/20 |

* cited by examiner

*Primary Examiner* — Bret Hayes
(74) *Attorney, Agent, or Firm* — Wood Herron & Evans LLP

(57) ABSTRACT

Provided is a retrofittable adjustable gas valve for an AK-pattern firearm having a standard gas block that receives a head portion of a gas piston. The gas valve includes a valve body configured to be at least partially received by a piston head-receiving portion of a standard AK-pattern gas block and has a gas passageway through it. A threaded adjustment valve member in the valve body has a stem portion configured to adjust gas flow through the gas passageway.

7 Claims, 5 Drawing Sheets

RETROFIT ADJUSTABLE GAS VALVE FOR LONG-STROKE PISTON-OPERATED FIREARM

RELATED APPLICATIONS

This application claims priority to U.S. Provisional Patent Application No. 62/663,320, filed Apr. 27, 2018, and incorporates the same herein by reference.

TECHNICAL FIELD

This invention relates to gas-operated firearms. In particular, it relates to a retrofittable valve for adjustably regulating gas flow in a long-stroke piston-operated firearm, such as an AK-pattern firearm.

BACKGROUND

AK-pattern firearms, including the AK-47, AKM, AK-74, and AK-100, are widely appreciated for their reliability, relatively low production costs, and ease of use. The construction and operation of AK-pattern firearms are well-known, but a brief description of the gas piston operating system will provide context for a later description of the present invention. Referring to FIGS. 1 and 2, therein are shown the relevant elements of a prior art AK-pattern gas piston system. A gas block 10 is mounted on a barrel 12. The bore 14 includes a gas port 16 aligned with a gas passageway 18 in the gas block 10. A gas piston 20 includes a head portion 22 that is received within a cylindrical chamber 24 of the gas block 10. At the opposite end of the gas piston is a connector portion 26 which is attached to a forward extension of the bolt carrier assembly (not shown) in a well-known manner. A gas tube 28 acts as a guide for the piston 20, rather than as a pressure chamber. In some models, the gas tube 28 has embossed flutes (not shown) that more closely guide the piston 20. This system is known as a "long stroke" gas piston, because the piston travels the same, full distance as the bolt carrier each time it cycles.

As a projectile is propelled through the bore 14 of the barrel 12, propellant gas flows through the gas port 16 and gas passageway 18 of the gas block 10 into the cylindrical chamber 24 to exert a force in the form of expanding gas pressure against the head 22 of the piston 20. The gas piston 20 is moved rearwardly by this force, which is transferred to the bolt carrier to cycle the action of the firearm in a well-known manner. The flow of gas through the gas port 16 and gas passageway 18 is unregulated, other than by the selected diameter of these passageways. AK-pattern firearms are sometimes considered to be "over-gassed," meaning that the flow and pressure of expanding gases exerted against the gas piston 20 are more than adequate to cycle the action. This over-gassing ensures that the firearm cycles reliably, but it may cause punishing wear to moving parts of the firearm. Adding a noise suppressor to the muzzle of the barrel 12 will increase back pressure in the bore 14 and other parts of the gas operating system, resulting in the action cycling too fast or with excessive force.

The nature and simplicity of the AK-pattern gas operating system makes the flow and pressure of operating gases difficult to regulate, at least without complete replacement of the gas block. Others have proposed using a partially vented piston head to allow bypass flow of gases to reduce the force exerted on the gas piston. However, there remains a need for a device that may be added to an existing AK-pattern firearm to adjustably regulate flow and pressure of operating gas without replacement of the gas block.

SUMMARY OF THE INVENTION

The present invention provides an adjustable gas valve that may be retrofitted to the existing gas block of a long-stroke, gas-operated firearm, such as an AK-pattern firearm, with the substitution of a minimum number of easily removed and replaced parts.

The gas valve includes a valve body configured to be at least partially received by a piston head-receiving portion of a standard AK-pattern gas block and has a gas passageway through it. A threaded adjustment valve member in the valve body has a stem portion configured to adjust gas flow through the gas passageway.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
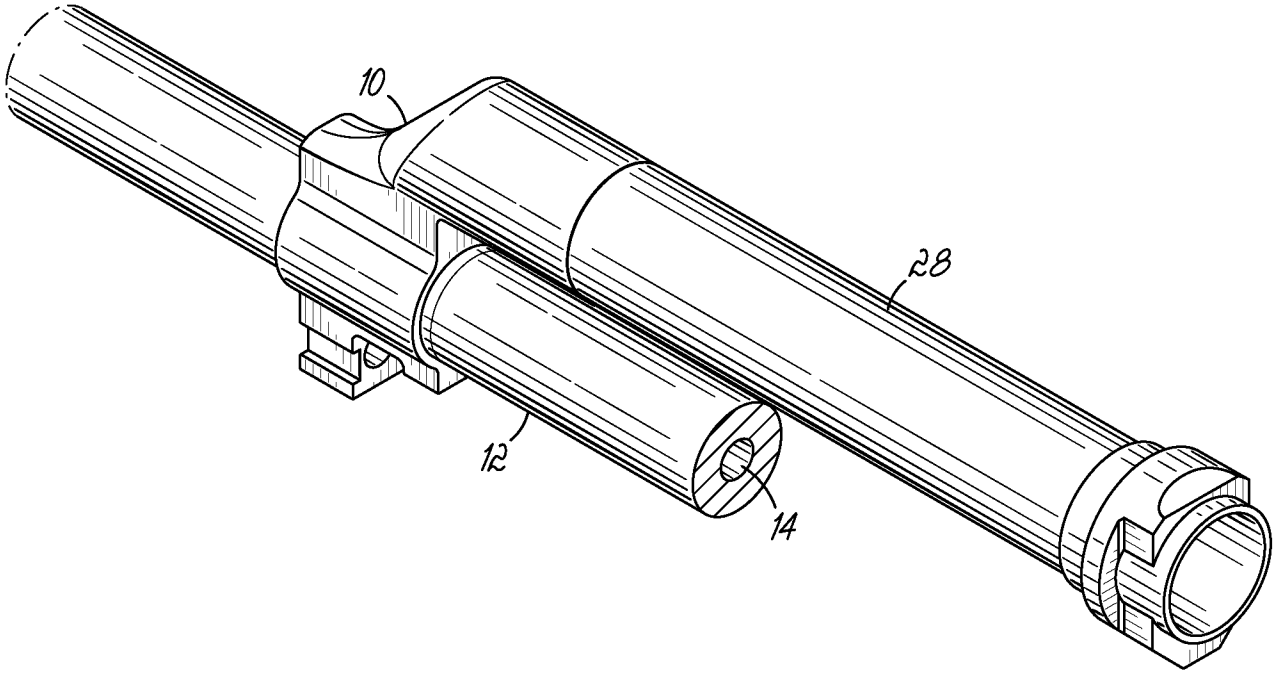
FIG. 1 PRIOR ART
FIG. 1 is a fragmentary isometric view showing relevant parts of a prior art AK-pattern firearm gas operating system.
Figure 2:
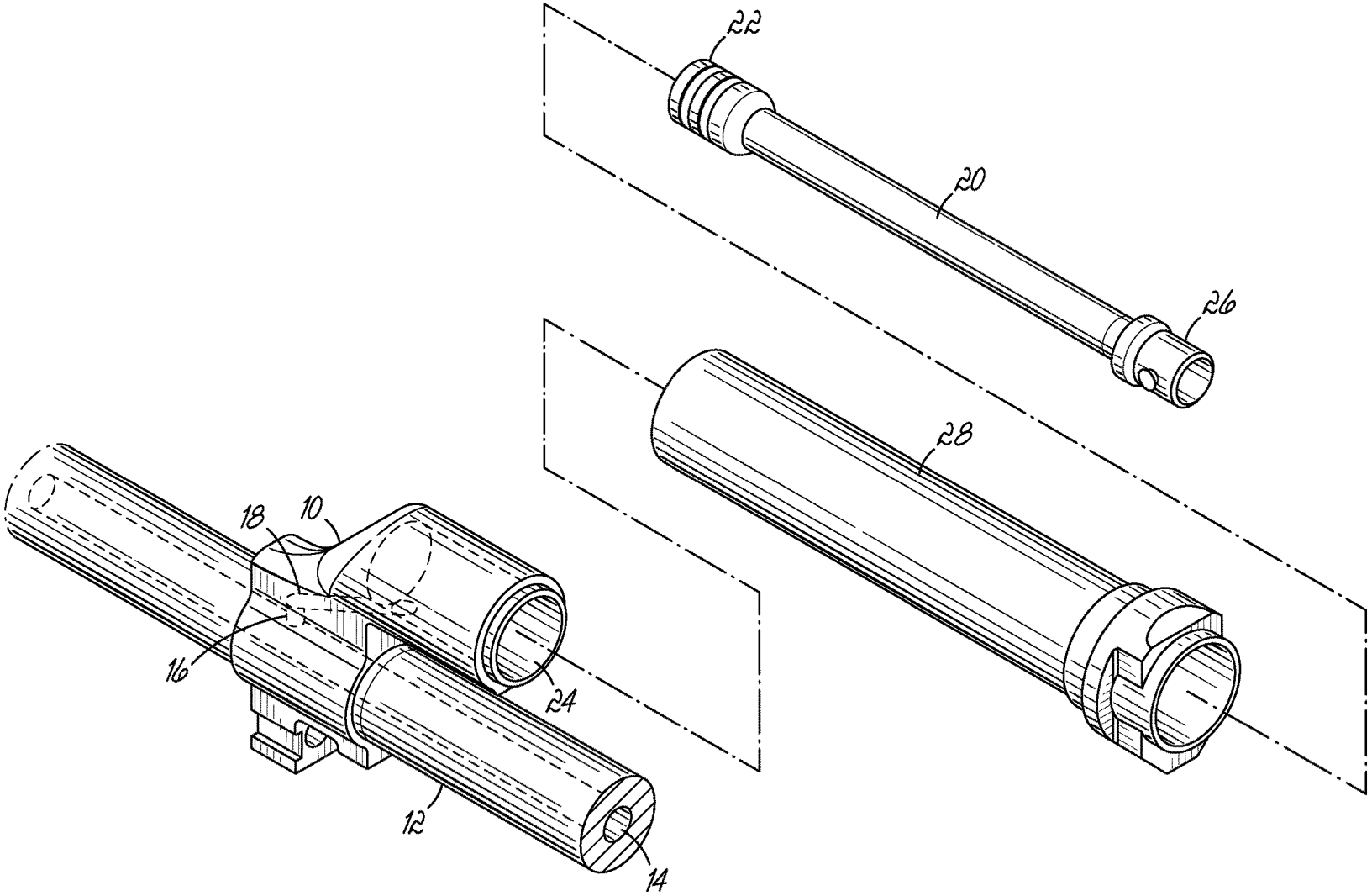
FIG. 2 PRIOR ART
FIG. 2 is an exploded view thereof.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Figure 3:
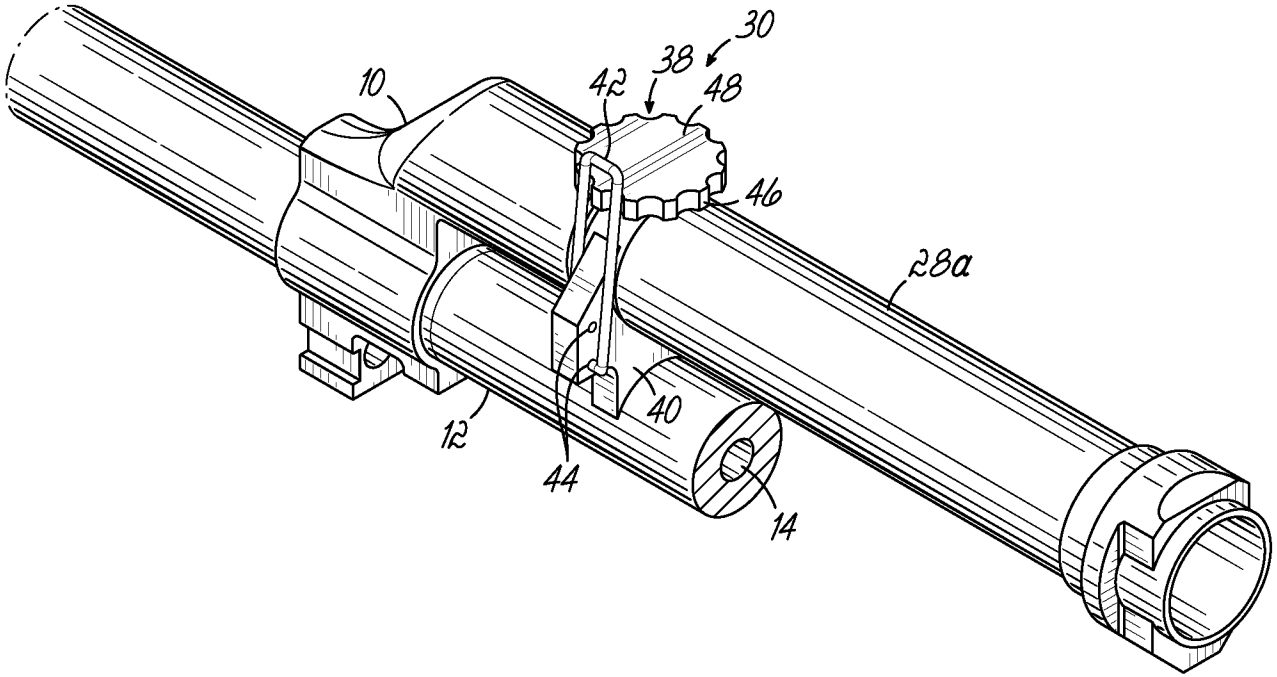
FIG. 3 is a fragmentary isometric view of an adjustable gas regulating valve assembled on the gas block of an AK-pattern firearm gas operating system.
Figure 4:
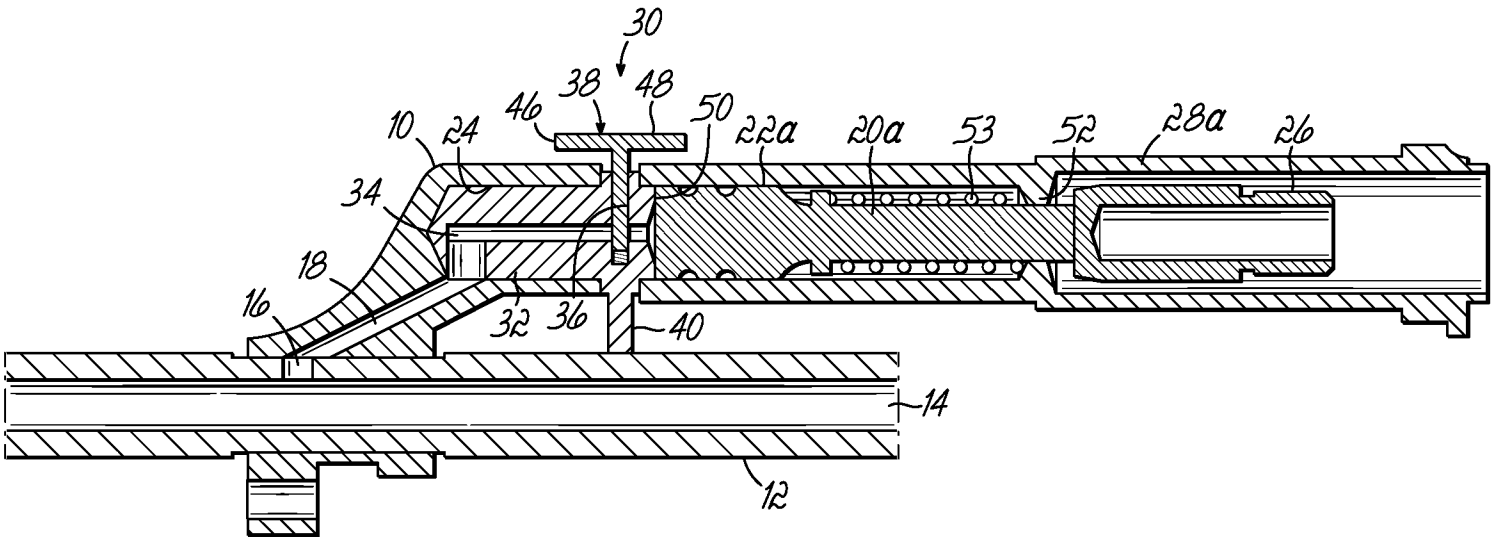
FIG. 4 is a longitudinal sectional view thereof.
Figure 5:
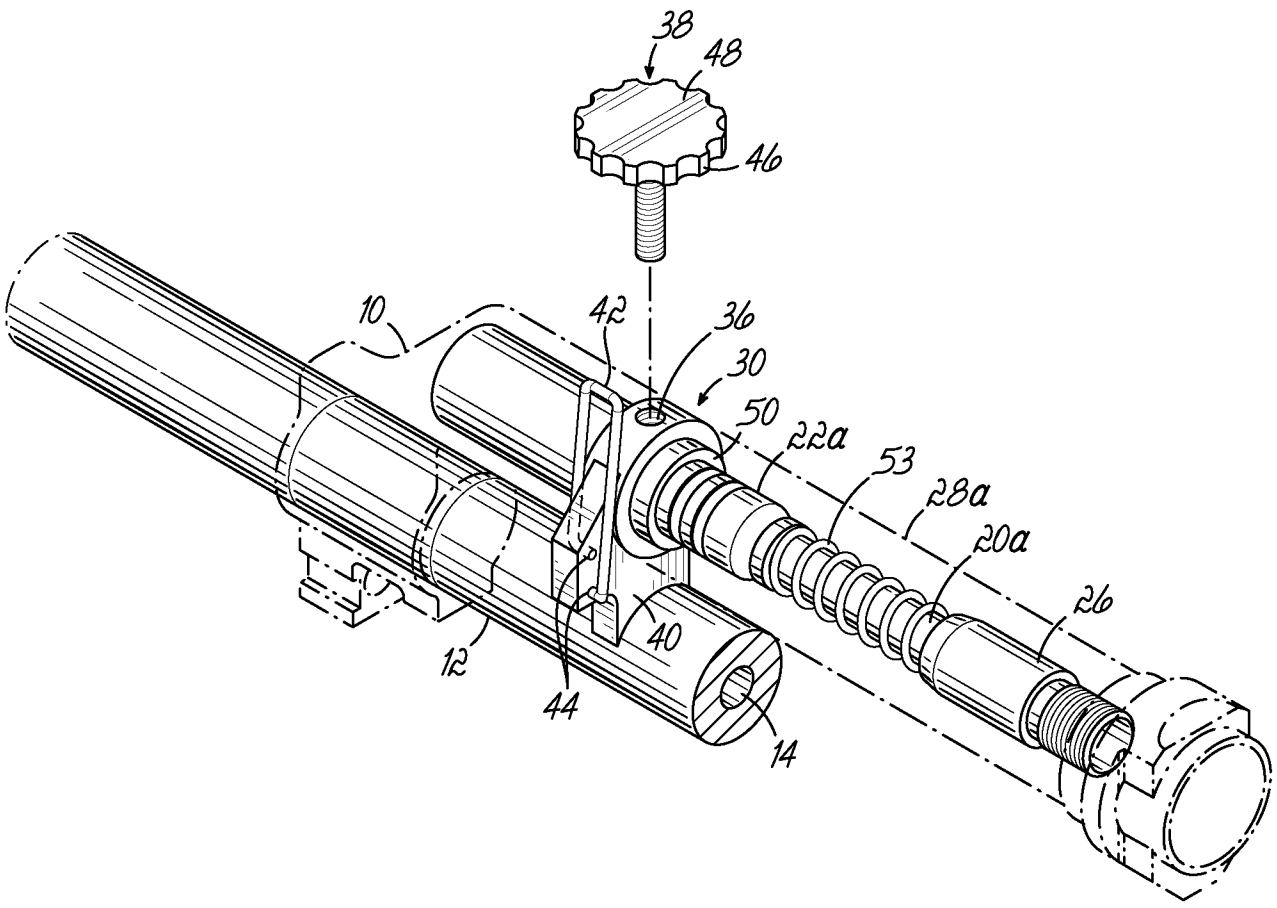
FIG. 5 is a similar view showing the gas block and gas tube in phantom.

Referring first to FIGS. 3-5, therein is shown an adjustable gas regulator 30 according to one embodiment of the present invention installed in the gas operating system of an AK-pattern firearm. The structure and function of the gas block 10, barrel 12, gas port 16, and gas passageway 18 described above remain unchanged. The regulator 30 includes a body 32 with an internal gas flow passageway 34 that operably communicates with the gas passageway 18 of the gas block 10. The body 32 includes a portion that fits closely into the cylindrical chamber 24 of the gas block 10, where the piston head 22 of a prior art gas piston 20 would ordinarily rest. Another portion of the regulator body 32 extends outwardly beyond the cylindrical chamber 24. This portion includes a threaded bore 36 configured to adjustably receive a threaded valve member 38. The threaded bore 36 is configured to intersect the gas passageway 34 of the body 32 so the valve member 38 may be adjusted between positions where the passageway 34 is completely closed, completely open, or at any number of positions in between where the gas passageway 34 is partially restricted. The body 32 may also include a leg portion 40 configured to rest against the barrel 12 and support the regulator 30 when installed in the gas block 10.

Various mechanisms may be used to retain the valve member 38 at a preselected adjustment position. In the illustrated embodiment, a detent spring 42 is mounted on a lateral extension of the body 32 with ends pivotally engaged in offset openings 44. This configuration allows the detent spring 42 to be manually pivoted to the side, causing temporary flexing of the spring's legs. Release of the manual deflection causes the detent spring 42 to return to its at rest position (as shown), bearing against a peripheral edge 46 of an enlarged head portion 48 of the treaded valve member 38. Rotation of the head portion 48 causes axial movement of the valve member 38. Detent engagement between the detent spring 42 and notches in the peripheral edge 46 of the head portion 48 releasably hold the valve member 38 in a selected position.

Because the gas regulator 30 extends outwardly behind the gas block 10, a shortened gas piston member 20*a* and shortened gas tube 28*a* are used in place of the corresponding original parts 20, 28. A forward end of the gas tube 28*a* engages the body 32 of the gas regulator 30, much like the original gas tube 28 engaged the gas block 10. Likewise, the head portion 22*a* of the piston 20*a* seats against an outlet opening 50 that is on a rear face of the body 32, downstream of the valve member 38. The head portion 22*a* may seat directly against the outlet opening 50 in the body 32, guided by the gas tube 28*a*. The replacement gas piston 20*a* includes a connector portion 26 mimicking that of the original gas piston 20 for connection to a forward extension of the bolt carrier (not shown). If desired, the gas tube 28*a* may include an internal shoulder 52 and a compression spring 53 can be inserted between the internal shoulder 52 and head portion 22*a* to bias the piston 28*a* toward the forward, in-battery position. If desired, the replacement piston 20*a* may be constructed with the head portion 22*a* and connector portion 26 as separate parts (as depicted in FIG. 4). This allows the head portion 22*a* to be returned forward by the spring 53 separate from the connector portion 26, which moves with the bolt carrier (not shown).

In operation, expanding propellant gases flow from the bore 14 of the barrel 12, through the gas port 16 and gas passageway 18 of the gas block, as before. With the adjustable gas regulator 30 of the present invention installed in the cylindrical chamber 24 of the gas block, propellant gasses now flow through the internal passageway 34, regulated by placement of the threaded valve member 38, before impinging on the head portion 22*a* of the gas piston 20*a* to displace it rearward, cycling the bolt carrier.

An adjustable gas regulator 30 of the present invention may be installed in an existing AK-pattern firearm without replacement or removal of the gas block 10 from the barrel 12. Instead only the original gas piston 20 and gas tube 28 are replaced, along with insertion of the gas regulator unit 30. The regulator 30 is accessible for operator adjustment without further modification to the AK-pattern firearm because it is situated forward of the handguard and handguard ferrule at a position where a forward portion of the original gas tube 28 would otherwise be exposed.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. An adjustable gas valve for a long-stroke gas-operated firearm having a gas block that receives a head portion of a gas piston, comprising:

a valve body separate from the gas block configured to be at least partially received by the piston head-receiving portion of the gas block, the valve body being assembled to a gas tube, the valve body and gas tube, when assembled together and installed in the gas block, configured to receive a head portion of the gas piston, the valve body having a gas passageway therethrough; and a threaded adjustment valve member in the valve body having a stem portion configured to adjust gas flow passing through the gas passageway from the gas block.

2. The adjustable gas valve of claim 1, wherein the valve body includes a portion configured to mate with a gas cylinder tube.

3. The adjustable gas valve of claim 1, further comprising a replacement gas piston and replacement gas cylinder tube that are each shortened in length relative to parts they replace.

4. The adjustable gas valve of claim 1, wherein the valve body includes a brace portion that is in contact with a barrel outer surface when installed.

5. The adjustable gas valve of claim 1, wherein the adjustment valve member is situated outside of the head-receiving portion of the gas block.

6. The adjustable gas valve of claim 1, wherein the valve stem portion is adjustable between fully open and fully closed positions.

7. An adjustable gas valve for a long-stroke gas-operated firearm having a gas block that receives a head portion of a gas piston, comprising:

a valve body separate from the gas block configured to be at least partially received by the piston head-receiving portion of the gas block, the valve body being assembled to a gas tube, the valve body and gas tube, when assembled together and installed in the gas block, configured to receive a head portion of the gas piston, the valve body having a gas passageway therethrough; and a threaded adjustment valve member in the valve body having a stem portion configured to adjust gas flow passing through the gas passageway from the gas block, wherein the adjustment valve member includes a head portion for hand adjustment thereof, the head portion including a circumferential series of notches at a periphery thereof, and further comprising a spring latch mounted on the valve body to engage at least one notch to prevent rotation of the adjustment valve member until released.

* * * * *